US011781283B2

(12) United States Patent
Allen

(10) Patent No.: US 11,781,283 B2
(45) Date of Patent: Oct. 10, 2023

(54) GRAPPLING APPARATUS AND METHODS OF MAKING AND USING SAME

(71) Applicant: B-LAIR RESEARCH AND DEVELOPMENT LLC, Oklahoma City, OK (US)

(72) Inventor: Stanley Blair Allen, Oklahoma City, OK (US)

(73) Assignee: B-Lair Research and Development LLC, Oklahoma City, OK (US)

( * ) Notice: Subject to any disclaimer, the term of this patent is extended or adjusted under 35 U.S.C. 154(b) by 647 days.

(21) Appl. No.: 16/734,120

(22) Filed: Jan. 3, 2020

(65) Prior Publication Data

US 2020/0370273 A1 Nov. 26, 2020

Related U.S. Application Data

(60) Provisional application No. 62/850,062, filed on May 20, 2019.

(51) Int. Cl.

| | |
|---|---|
| ***E02F 3/413*** | (2006.01) |
| ***B66F 9/20*** | (2006.01) |
| ***B66F 9/18*** | (2006.01) |

(52) U.S. Cl.

CPC ..... *E02F 3/413* (2013.01); *B66F 9/18* (2013.01); *B66F 9/20* (2013.01)

(58) Field of Classification Search

CPC ..... E02F 3/413; B66F 9/18; B66F 9/20
See application file for complete search history.

(56) References Cited

U.S. PATENT DOCUMENTS

| | | | | |
|---|---|---|---|---|
| 3,177,029 | A * | 4/1965 | Larson | B66C 3/16 294/198 |
| 3,631,995 | A * | 1/1972 | Jones | B66C 3/20 414/731 |
| 4,005,894 | A * | 2/1977 | Tucek | B66C 3/16 414/733 |
| 4,542,929 | A * | 9/1985 | Possinger | E02F 3/4135 37/468 |
| 4,703,968 | A * | 11/1987 | LaBounty | B66C 3/16 294/902 |
| 4,906,161 | A * | 3/1990 | Weyer | E02F 3/345 37/468 |

(Continued)

*Primary Examiner* — Saul Rodriguez
*Assistant Examiner* — Ashley K Romano
(74) *Attorney, Agent, or Firm* — Hall Estill Law Firm; Michael H. Smith

(57) ABSTRACT

A grappling apparatus usable with a vehicle is provided. The grappling apparatus includes a connection assembly, a grappling assembly and a stabilizing assembly. The connection assembly connects the grappling apparatus to the vehicle. The grappling assembly has an upper claw assembly and a lower claw assembly. The upper claw assembly has a first plurality of manipulator arms and a walking gear. The lower claw assembly has a second plurality of manipulator arms and a stabilizer gear. The walking gear is meshable with the stabilizer gear and the first and second plurality of manipulator arms are operably connected to the walking gear and the stabilizer gear so as to be moveable between a closed position and an open position. The stabilizing assembly has a stabilizer bar operably connected to the second plurality of manipulator arms and the vehicle so as to stabilize the at least one stabilizer gear.

15 Claims, 5 Drawing Sheets

(56) References Cited

U.S. PATENT DOCUMENTS

| | | | | | |
|---|---|---|---|---|---|
| 5,074,740 | A * | 12/1991 | Weigel | B66C 1/427 | 294/67.31 |
| 5,121,557 | A * | 6/1992 | Moore | E02F 3/352 | 37/406 |
| 5,330,242 | A * | 7/1994 | Lucky, Sr. | B66C 3/04 | D15/28 |
| 5,515,626 | A * | 5/1996 | Holscher | E02F 3/3622 | 37/468 |
| 5,579,816 | A * | 12/1996 | Hill | A01G 23/003 | 144/34.1 |
| 5,626,457 | A * | 5/1997 | Hickman, Jr. | B25J 9/046 | 173/185 |
| 5,649,377 | A * | 7/1997 | Tanada | E02F 3/404 | 37/406 |
| 5,788,450 | A * | 8/1998 | Willis | A01G 23/003 | 180/908 |
| 6,126,216 | A * | 10/2000 | Tollefson | B66C 3/04 | 37/406 |
| 6,370,801 | B1 * | 4/2002 | Weyer | E02F 3/964 | 37/409 |
| 6,457,761 | B1 * | 10/2002 | Benoit | B66C 1/58 | 294/201 |
| 8,210,587 | B2 * | 7/2012 | Mizelmoe | B66C 1/427 | 294/201 |
| 8,752,876 | B2 * | 6/2014 | Niekamp | E04H 17/263 | 294/198 |
| 9,781,885 | B2 * | 10/2017 | Niekamp | A01G 23/065 | |
| 2002/0113448 | A1 * | 8/2002 | Kazerooni | B66D 3/18 | 294/106 |
| 2008/0086920 | A1 * | 4/2008 | Lim | E02F 3/404 | 37/406 |

* cited by examiner

GRAPPLING APPARATUS AND METHODS OF MAKING AND USING SAME

CROSS REFERENCE TO RELATED APPLICATIONS/INCORPORATION BY REFERENCE STATEMENT

The present application claims priority and benefit under 35 U.S.C. 119(e) to U.S. Ser. No. 62/850,062, filed on May 20, 2019, the entire contents of all which are hereby expressly incorporated herein by reference.

FIELD OF THE DISCLOSURE

The present disclosure relates generally to a grappling apparatus for use in grasping, lifting and carrying various objects, and more particularly, but not by way of limitation, to an improved grappling apparatus and methods of making and using the grappling apparatus.

BACKGROUND OF THE INVENTION

Grappling devices are well known for being attached to tractors, excavators and other such vehicles so as to grasp, lift and carry various sized objects and moving them from one location to another. However, many grappling devices have limitations.

To this end, although grappling devices of the existing art are operable, further improvements are desirable and a need remains to provide a grappling apparatus and method of use whereby the grappling apparatus is constructed in such a manner that it is mounted to a vehicle for lifting and moving objects between locations. It is to such a grappling apparatus, and method of making and using, that at least one embodiment of the present invention is directed.

DETAILED DESCRIPTION OF THE INVENTION

Figure 1:
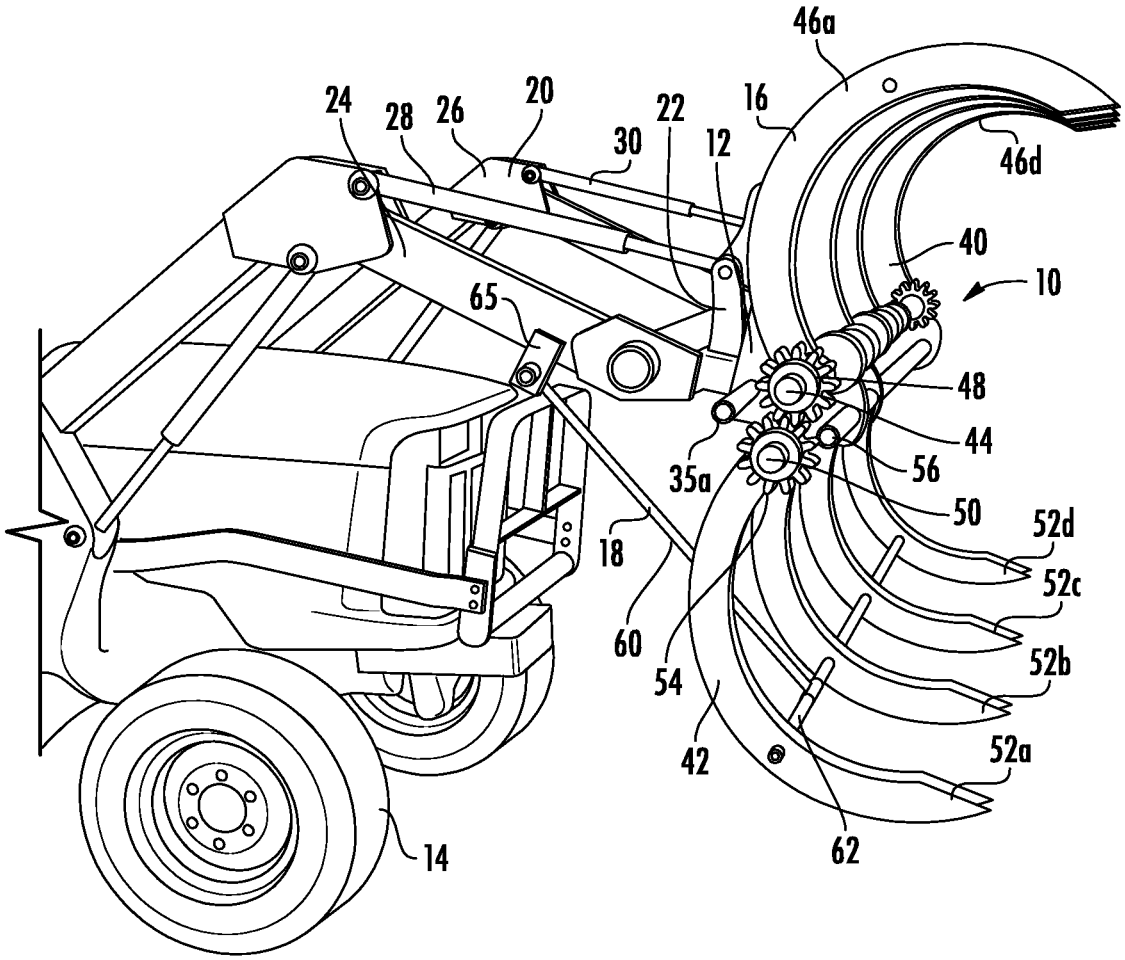
FIG. 1 is a perspective view of one embodiment of a grappling apparatus constructed in accordance with the present disclosure, the grappling apparatus in an open position and mounted to a front end of a conventional tractor.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way. For example the device could be shortened, lengthened and configured to utilize other types of grasping tools.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a nonexclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
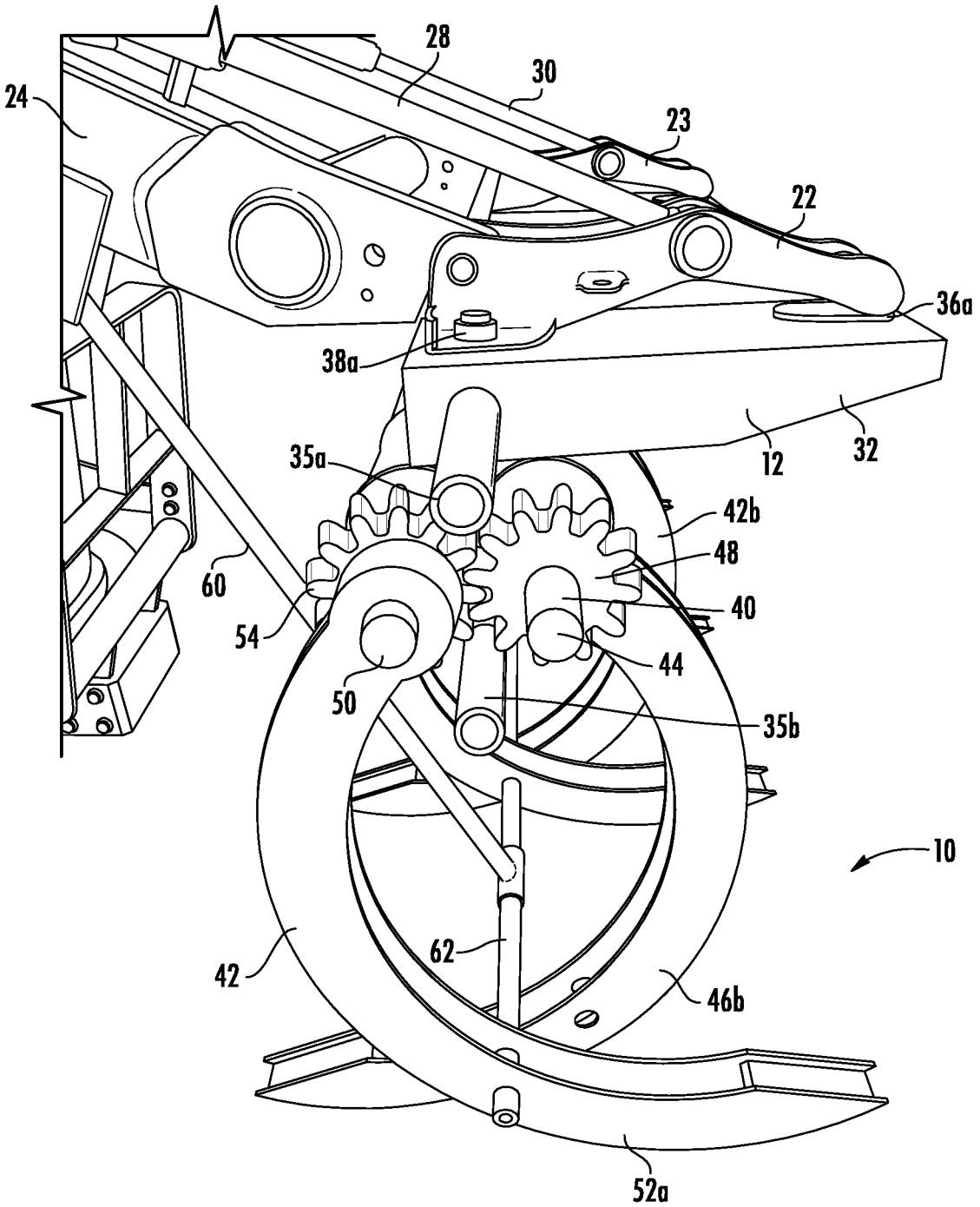
FIG. 2 is a perspective side view of the grappling apparatus of FIG. 1 in a closed position.
Figure 3:
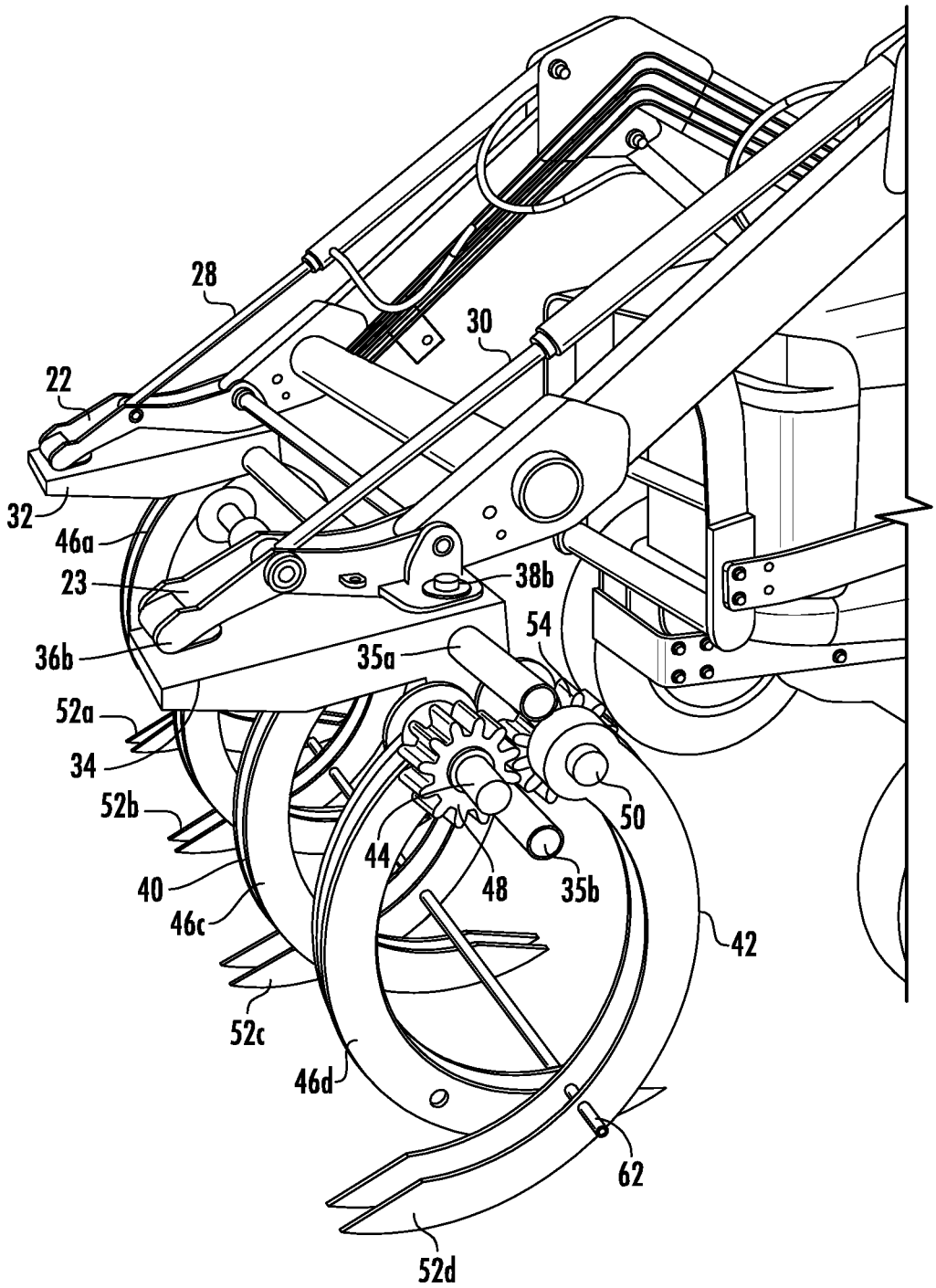
FIG. 3 is an opposite side view of the grappling apparatus of FIG. 2.
Figure 4A:
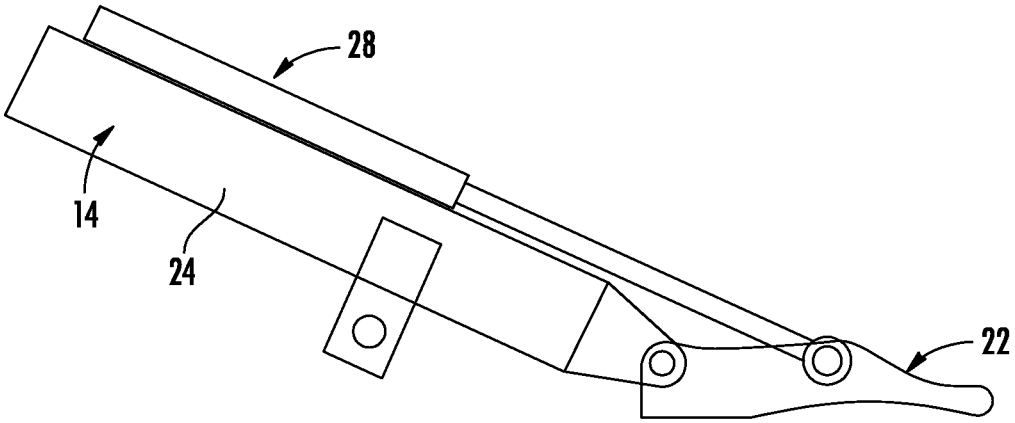
FIG. 4*a* is a side elevational view of a portion of a front end loader of a piece of equipment.
Figure 4B:
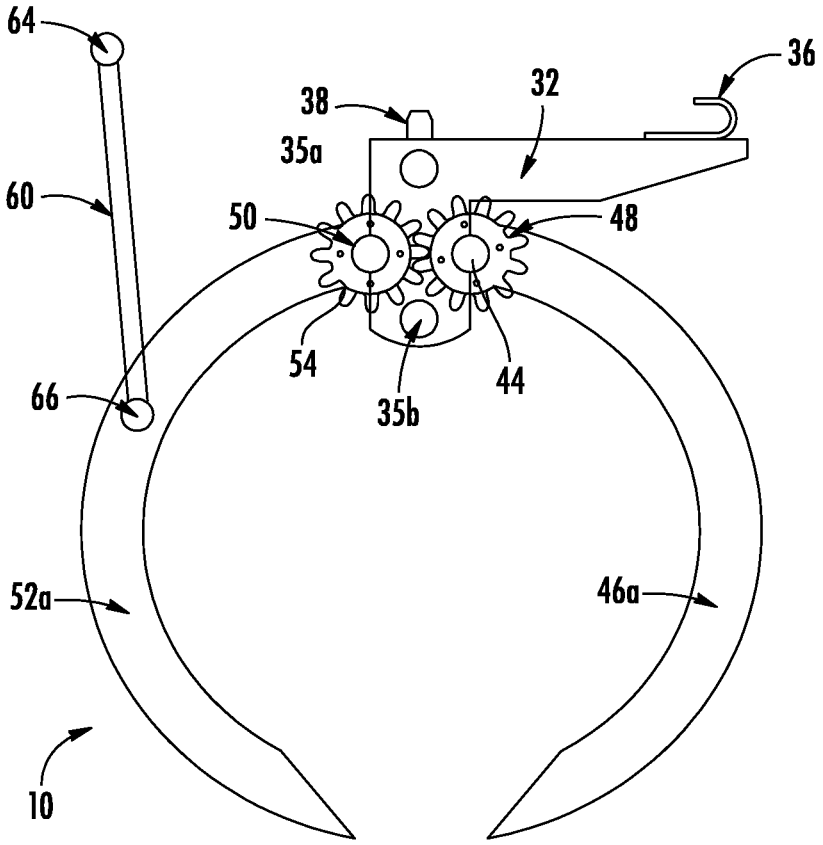
FIG. 4*b* is a side elevational view of a grappling apparatus.
Figure 5:
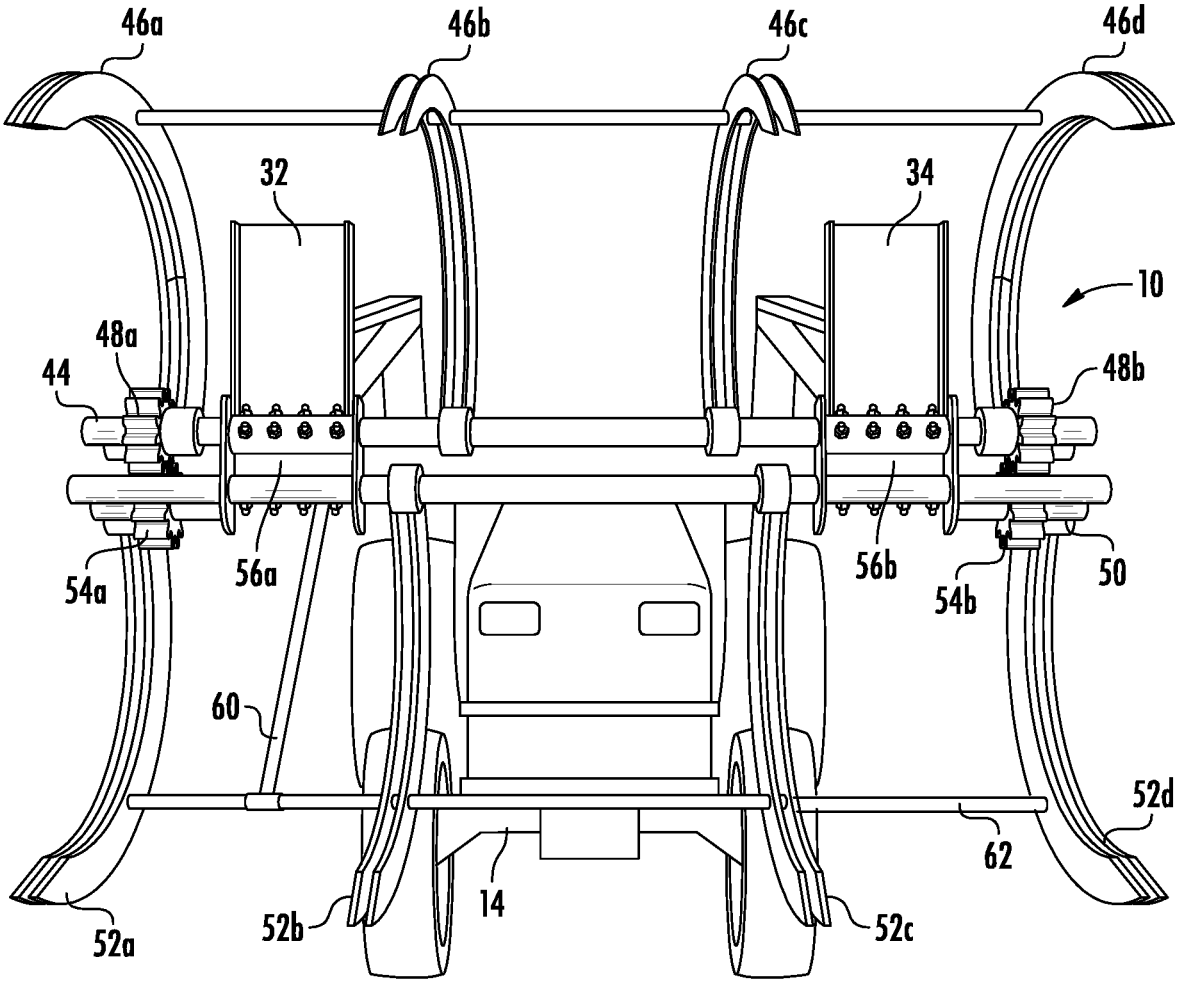
FIG. 5 is a perspective front view of the grappling apparatus of FIG. 1.

Referring now to FIGS. 1-4, one embodiment of a grappling apparatus 10 constructed in accordance with the inventive concepts disclosed herein is illustrated. The grappling apparatus 10 is shown mounted to a conventional tractor 12. The grappling apparatus 10 may be used for moving stumps, pipes, brush, trash, hay bales, rocks, lumber, or other objects that can be lifted by a grappling type action. Broadly, the grappling apparatus 10 may include a connection assembly 14, a grappling assembly 16 and a stabilizing assembly 18.

Although the grappling apparatus 10 is shown removably connected to a conventional tractor 12, it will be understood by one of ordinary skill in the art, that the grappling apparatus 10 may be utilized with other types of equipment such as, excavators, backhoes, skid loaders, end loaders, construction equipment, other equipment have booms or hydraulic capability, or the like. Further, it will be understood that the examples described herein should not be considered to be limiting. It should also be understood that though the apparatus 10 may be configured in various embodiments for gripping and grappling like uses.

As discussed herein, in one embodiment, the grappling apparatus 10 will be described as it is used on a front end loader mechanism 20 having a quick disconnect coupler or pivot arms 22 and 23 on the tractor 12. The front end loader mechanism 20 is provided with a pair of arms 24 and 26 and a pair of hydraulic activators 28 and 30 operationally connected to the arms 24 and 26, respectively. The attachment configuration for such types of equipment being connected to the tractor 12 is well known to those having ordinary skill in the art and, as such, will not be further described herein. A tractor has two arms and an excavator may only have one arm with a pivoting end. Thus, it will be understood by one of ordinary skill in the art, the grappling apparatus 10 is not limited to two arm equipment and could be configured in various ways accordingly to the type of equipment with which the grappling apparatus 10 is being used.

The hydraulic activators 28 and 30 may be powered by any suitable hydraulic power system (not shown). The activators 28 and 30 may be powered by the piece of the tractor 12. Because the use of hydraulic circuits, as well as their various components, is well known in the art, the hydraulic hosing and components used with the present inventive concepts have been omitted from the drawings for the sake of clarity. The grappling apparatus 10 does not use a third hydraulic actuator as is typical with other grappling devices. The present disclosure uses the existing hydraulics found on the tractor, by way of example, and the pivoting motion supplied by the tractor and the stabilizing assembly.

The connection assembly 14 of the grappling apparatus 10 includes a first body 32 and a second body 34 positioned a distance from the first body 32. The first body 32 is connected to the second body 34 by a first shaft 35*a* and a second shaft 35*b* for stabilizing and strengthening the first body 32 to the second body 34. A quick disconnect 36*a* and 36*b* and a quick disconnect pin 38*a* and 38*b* are provided on the first body 32 and the second body 34, respectively, so that the first body 32 is removably connectable to the pivot arm 22 and the second body 34 is removably connectable to the pivot arm 23 of the tractor 12.

It will be understood that the connection assembly 14 of the grappling apparatus 10 may be configured in any suitable form capable of supporting the grappling assembly 16 and the stabilizing assembly 18. In one embodiment, the connection assembly 14 may be formed as a part of a piece of the tractor 12, or other piece of equipment, such that the piece of the tractor 12 serves as the connection assembly 14. In embodiments, where the equipment only has one pivot arm, only a single body may be included in the connection assembly for connecting the grappling apparatus to the equipment.

The grappling assembly 16 includes an upper claw assembly 40 and a lower claw assembly 42 that operate together to provide the grappling like motion of the grappling assembly 16. The upper claw assembly 40 includes a rotating shaft 44, a plurality of manipulator arms 46*a*-46*d* and a walking gear 48 (a and b). The lower claw assembly 42 includes a rotating shaft 50, a plurality of manipulator arms 52*a*-52*d* and a stabilizer gear 54 (a and b). The rotating shafts 44 and 50 are rotatably connected to the first body 32 and the second body 34 with pillow block setups 56*a* and 56*b*, respectively. The plurality of manipulator arms 46*a*-46*d* and the walking gear 48 are connected to the rotating shaft 44 and the plurality of manipulator arms 52*a*-52*d* and the stabilizer gear 54 are connected to the rotating shaft 50.

The stabilizing assembly 18 includes a stabilizer bar 60 and a stabilizing rod 62 so as to provide stability to the grappling assembly 10. One end 64 of the stabilizer bar 60 is connected to a portion of the arm 24 of the tractor 12 with a connector 65 and an opposite end 66 of the stabilizer bar 60 is connected to the stabilizing rod 62. The stabilizing rod 62 is connected to the plurality of manipulator arms 52*a*-52*d* of the lower claw assembly 42.

As the pivot arms 22 and 23 rotate upward, the stabilizer bar 60 prevents the rotating shaft 50 and the stabilizer gear 54 from rotating upward when the first and second bodies 32 and 34 force the walking gear 48 attached to the rotating shaft 44 to rotate around the stabilizer gear 54 which forces the plurality of manipulator arms 46*a*-46*d* that are attached to the rotating shaft 44 and the walking gear 48 to open up as the walking gear 48 "walks" or moves up the stabilizer gear 54. Some movement of the stabilizer gear 54 is allowed by the pillow boxes 56*a* and 56*b* as the stabilizer gear 54, the rotating shaft 50 and the plurality of manipulator arms 52*a*-52*d* rotate within the pillow boxes 56*a* and 56*b*. As the walking gear 48 rotates around the stabilizer gear 54, the movement functions to move the plurality of manipulator arms 46*a*-46*d* and 52*a*-52*d* between an open position and a closed position. It will be understood that in the open position, the plurality of manipulator arms 46*a*-46*d* and the plurality of stabilizing arms 52*a*-52*d* are moved away from each other and in the closed position, the plurality of manipulator arms 46*a*-46*d* and the plurality of stabilizing arms 52*a*-52*d* are moved toward each other.

In use, for example, the grappling apparatus 10 may be utilized to move the trunk of a tree. As has been discussed herein, it should be understood by one of ordinary skill in the art that the grappling apparatus 10 may be utilized for various projects or uses requiring a grappling like motion. Initially, the connection assembly 14 of the grappling apparatus 10 is attached to the tractor 12. An operator may manipulate the height and orientation of the grappling apparatus 10 by pivoting the arms 24 and 26 of the tractor 12. It will be understood that the grappling apparatus 10 may also be raised and lowered with capabilities available on the tractor 12, for example, a boom, lift, or elevator (not shown).

In use, the hydraulic actuators 28 and 30 of the tractor 12 are activated to pull on the pivot arms 22 and 23 of the tractor 12. The stabilizer bar 60 of the stabilizing assembly 18 of the grappling apparatus 10 maintains the plurality of manipulator arms 52*a*-5*d*2 and the stabilizer gear 54 and prevents them from rotating. The force from the actuators 28 and 30 in combination with the resistance from the stabilizing assembly 18, forces the walking gear 48 and the plurality of manipulator arms 46*a*-46*d* operably connected to the walking gear 48 to move in a direction up the stabilizer gear 54 such that the plurality of manipulator arms 46*a*-46*d* move in a direction away from the plurality of manipulator arms 52*a*-52*d* so that the grappling apparatus 10 moves toward an open position.

The operator moves the tractor 12 forward such that the plurality of manipulator arms 46*a*-46*d* and 52*a*-52*d* of the grappling assembly 16 engage the trunk to be gripped. The hydraulic actuators 28 and 30 of the tractor 12 are activated to push on the pivot arms 22 and 23 of the tractor 12. The walking gear 48 and the plurality of manipulator arms 46*a*-46*d* operably connected to the walking gear 48 move in a direction down the stabilizer gear 54 such that the plurality of manipulator arms 46*a*-46*d* move toward the plurality of manipulator arms 52*a*-52*d* so that the grappling apparatus 10 moves into a closed position to grip the trunk of the tree. The tree trunk is lifted and moved to the desired location by the tractor 12. The grappling apparatus 10 is moved into the open position so as to disengage the trunk and drop it on the ground.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and claimed herein.

What is claimed is:

1. A grappling apparatus, comprising:

a connection assembly removably connecting the grappling apparatus to a movable loader arm of a vehicle;

a grappling assembly attached to the connection assembly, the grappling assembly comprising:

an upper claw assembly having a first plurality of manipulator arms and a walking gear; and a lower claw assembly having a second plurality of manipulator arms and a stabilizer gear wherein the walking gear is meshable with the stabilizer gear and wherein the first plurality of manipulator arms are operably connected to the walking gear and the second plurality of manipulator arms are operably connected to the stabilizer gear so as to be moveable between a closed position and an open position such that the upper claw assembly and the lower claw assembly operate together to provide a grappling like motion when the movable loader arm of the vehicle is actuated; and a stabilizing assembly having a stabilizer bar operably connected to the second plurality of manipulator arms and the vehicle so as to stabilize the at least one stabilizer gear and the second plurality of manipulator arms operably connected to the at least one stabilizer gear so as to provide stability to the grappling assembly.

2. The grappling apparatus of claim 1 wherein the connection assembly includes a first body connected to a second body positioned a distance from the first body wherein the first body and the second body are removably connectable to the vehicle.

3. The grappling apparatus of claim 2 wherein the first body is connected to the second body by a first shaft and a second shaft for stabilizing and strengthening the first body to the second body.

4. The grappling apparatus of claim 1 the first plurality of manipulator arms and the walking gear are connected to a first rotating shaft and the second plurality of manipulator arms and the stabilizer gear are connected to a second rotating shaft.

5. The grappling apparatus of claim 4 wherein the first rotating shaft and the second rotating shaft are rotatably connected to a portion of the connection assembly.

6. The grappling apparatus of claim 1, the stabilizing assembly, further comprising:

a stabilizing rod operably connected to the second plurality of manipulator arms wherein one end of the stabilizer bar is removably connected to the vehicle and the other end of the stabilizer bar is connected to the stabilizing rod.

7. A vehicle for grasping an object, comprising:

a body having at least one pivot arm and a plurality of wheels; and a grappling apparatus connected to the at least one pivot arm, comprising:

a grappling assembly, comprising:

an upper claw assembly having a first plurality of manipulator arms and a walking gear; and a lower claw assembly having a second plurality of manipulator arms and a stabilizer gear wherein the walking gear is meshable with the stabilizer gear and wherein the first plurality of manipulator arms are operably connected the walking gear and the second plurality of manipulator arms are operably connected to the stabilizer gear so as to be moveable between a closed position and an open position such that the upper claw assembly and the lower claw assembly operate together to provide a grappling like motion when the at least one pivot arm of the body of the vehicle is actuated; and a stabilizing assembly having a stabilizer bar operably connected to the second plurality of manipulator arms and the vehicle so as to stabilize the at least one stabilizer gear and the second plurality of manipulator arms operably connected to the at least one stabilizer gear so as to provide stability to the grappling assembly.

8. The grappling apparatus of claim 7 the first plurality of manipulator arms and the walking gear are connected to a first rotating shaft and the second plurality of manipulator arms and the stabilizer gear are connected to a second rotating shaft.

9. The grappling apparatus of claim 8 wherein the first rotating shaft and the second rotating shaft are rotatably connected to a portion of the connection assembly.

10. The grappling apparatus of claim 7, the stabilizing assembly, further comprising:

a stabilizing rod operably connected to the second plurality of manipulator arms wherein one end of the stabilizer bar is removably connected to the vehicle and the other end of the stabilizer bar is connected to the stabilizing rod.

11. A grappling apparatus, comprising:

a connection assembly removably connecting the grappling apparatus to a movable loader arm of a vehicle;

a grappling assembly attached to the connection assembly, the grappling assembly comprising:

an upper claw assembly having at least three manipulator arms and a walking gear connected along a first rotating shaft; and a lower claw assembly having at least three manipulator arms and a stabilizer gear connected along a second rotating shaft wherein the walking gear is meshable with the stabilizer gear and wherein the at least three manipulator arms of the upper claw assembly are operably connected to the walking gear and the at least three of manipulator arms of the lower claw assembly are operably connected to the stabilizer gear so as to be moveable between a closed position and an open position such that the upper claw assembly and the lower claw assembly operate together to provide a grappling like motion when the movable loader arm of the vehicle is actuated; and a stabilizing assembly having a stabilizer bar operably connected to the at least three manipulator arms of the lower claw assembly and the vehicle so as to stabilize the at least one stabilizer gear and the at least three manipulator arms of the lower claw assembly operably connected to the at least one stabilizer gear so as to provide stability to the grappling assembly.

12. The grappling apparatus of claim 11 wherein the connection assembly includes a first body connected to a second body positioned a distance from the first body wherein the first body and the second body are removably connectable to the vehicle.

13. The grappling apparatus of claim 12 wherein the first body is connected to the second body by a first shaft and a second shaft for stabilizing and strengthening the first body to the second body.

14. The grappling apparatus of claim 11 wherein the first rotating shaft and the second rotating shaft are rotatably connected to a portion of the connection assembly.

15. The grappling apparatus of claim 11, the stabilizing assembly, further comprising:

a stabilizing rod operably connected to the at least three manipulator arms of the lower claw assembly wherein one end of the stabilizer bar is removably connected to the vehicle and the other end of the stabilizer bar is connected to the stabilizing rod.

* * * * *